US007098797B2

(12) United States Patent
Chahrour et al.

(10) Patent No.: US 7,098,797 B2
(45) Date of Patent: Aug. 29, 2006

(54) FIRE OR OVERHEATING DETECTION SYSTEM

(75) Inventors: Wael Chahrour, Chatou (FR); Jean Paul Colombier, Noisy le Grand (FR); Philippe Mangon, Elancourt (FR)

(73) Assignee: Cerberus S.A.S., BUC Cedex (FR)

( * ) Notice: Subject to any disclaimer, the term of this patent is extended or adjusted under 35 U.S.C. 154(b) by 162 days.

(21) Appl. No.: 10/791,214

(22) Filed: Mar. 2, 2004

(65) Prior Publication Data

US 2004/0233062 A1 Nov. 25, 2004

(30) Foreign Application Priority Data

Mar. 3, 2003 (FR) ..... 03 02579

(51) Int. Cl.
*G08B 17/00* (2006.01)

(52) U.S. Cl. ..... 340/584; 340/589

(58) Field of Classification Search ..... 340/584, 340/577, 578, 587, 589, 655
See application file for complete search history.

(56) References Cited

U.S. PATENT DOCUMENTS 5,225,811 A * 7/1993 Audy ..... 340/584
5,254,975 A * 10/1993 Torikoshi ..... 340/589
5,973,605 A * 10/1999 Yamanashi ..... 340/653
6,288,638 B1 * 9/2001 Tanguay et al. ..... 340/514

* cited by examiner

*Primary Examiner*—John Tweel, Jr.
(74) *Attorney, Agent, or Firm*—Maginot, Moore & Beck

(57) ABSTRACT

A system for detecting fire or overheating includes a sensor including at least one material having a resistance with a selected temperature coefficient, wherein the resistance of the material is indicative of a temperature. The system includes further a device connected to the sensor to perform measurements on the material, wherein the device is configured to determine at least one parameter from the measurements and to analyze a dynamic behaviour of the at least one parameter to deduce status information including overheating and malfunction of the sensor.

19 Claims, 5 Drawing Sheets

FIRE OR OVERHEATING DETECTION SYSTEM

BACKGROUND OF THE INVENTION

1. Field of the Invention

The present invention relates to a system for detecting fire or overheating.

2. Description of the Related Art

A variety of different systems and methods for detecting fire or overheating are known. These systems are often used in engine regions, for example, of an aircraft, ship, helicopter, submarine, space shuttle or industrial plant, and more generally in any sensitive region where the risk of fire or overheating exists, for example, in a hold or bunker, train compartment or boiler.

U.S. Pat. No. 5,136,278 describes one type of detector that detects local or average overheating. The detector uses a gas which, when it expands owing to the effect of overheating, trips an electrical contact, thereby indicating that a mean temperature of the detector has exceeded a threshold temperature. Metal oxides with an absorbed gas distributed over the entire length of the detector provide, by a degassing principle, a local indication that the temperature exceeds the threshold temperature.

Another type of detector measures the resistance of a material having a negative thermal coefficient ("NTC"). The material may be implemented as a negative thermal coefficient cable. This type of detector is used for detecting local overheating.

SUMMARY OF CERTAIN INVENTIVE ASPECTS

A gas-type detector requires moving parts to be joined together and has, therefore, a complicated, fragile and expensive construction. An NTC-type detector applies the resistance as the sole criterion and is not very robust in fault situations. It is, therefore, an objective to provide a system for detecting fire or overheating that has improved features with respect to construction and robustness.

One inventive aspect involves a system for detecting fire or overheating. The system includes a sensor including at least one material having a resistance with a selected temperature coefficient, wherein the resistance of the material is indicative of a temperature. The system includes further a device connected to the sensor to perform measurements on the at least one material, wherein the device is configured to determine at least one parameter from the measurements and to analyze a dynamic behaviour of the at least one parameter to deduce status information including overheating and malfunction of the sensor.

Another inventive aspect involves a method of detecting fire or overheating. The method performs measurements on at least one material having a resistance with a selected temperature coefficient and included in a sensor that is coupled to a device, wherein the resistance of the material is indicative of a temperature. At least one parameter is determined from the measurements. A dynamic behaviour of the at least one parameter is analyzed to deduce status information including overheating and malfunction of the sensor.

The system proposed has in particular the advantage of carrying out processing operations that take into account fouling situations or failure situations (a short circuit, open circuit, etc.). It also has the advantage of allowing thermal profiles to be determined in real time.

BRIEF DESCRIPTION OF THE DRAWINGS

These and other aspects, advantages and novel features of the embodiments described herein will become apparent upon reading the following detailed description and upon reference to the accompanying drawings. In the drawings, same elements have the same reference numerals.

DETAILED DESCRIPTION OF CERTAIN INVENTIVE EMBODIMENTS

Figure 1:
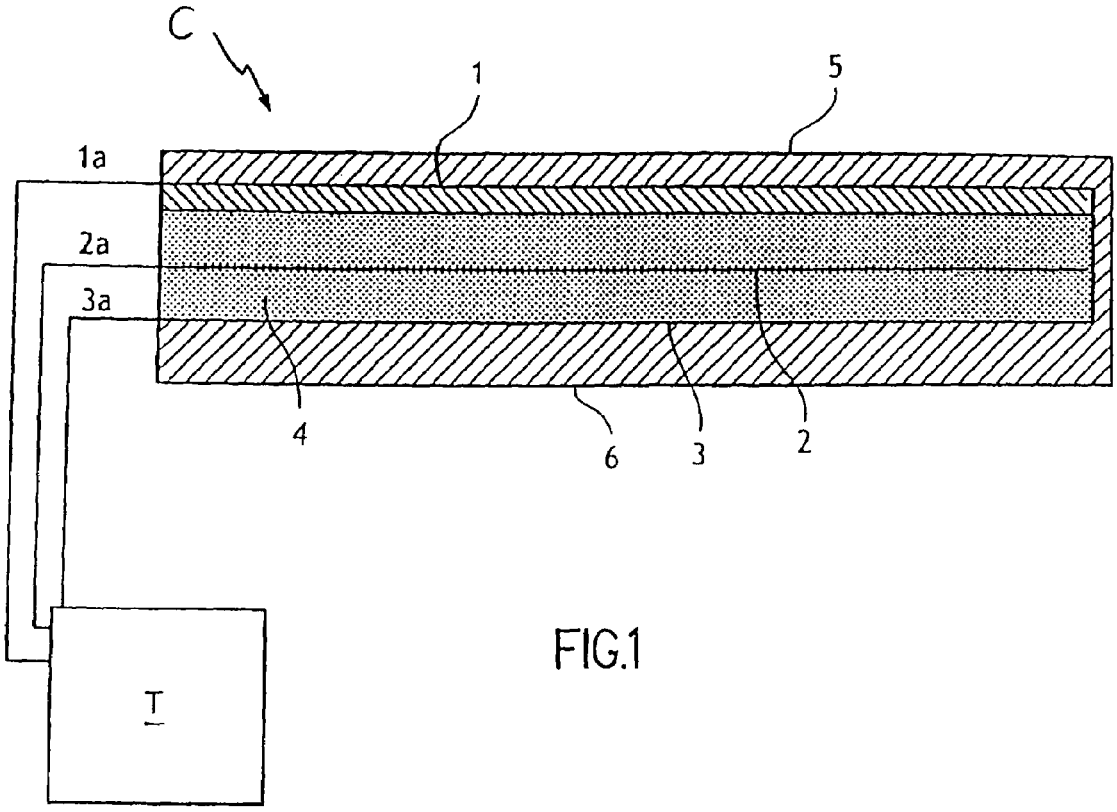
FIG. 1 is a schematic representation of one embodiment of a system for detecting fire or overheating.

FIG. 1 shows a schematic illustration of one embodiment of a system for detecting fire or overheating. In one application, the system may be installed in an automobile, train, aircraft or ship, for example, next to or within an engine, passenger or cargo compartment, to detect a fire or overheating. It is contemplated that the system may be installed at any location where the risk of fire or overheating exists, such as at an industrial site, a power generation or transformer station, a data processing or storage room, or an aircraft engine, in particular a jet engine, passenger or cargo compartment.

The system according to one embodiment comprises a sensor C and a device T connected to the sensor C. The device T measures and processes characteristics obtained from the sensor C. The sensor C comprises a conducting core 2 extending within a sheath 3 that is conducting. For example, the core 2 may extend along a longitudinal axis of the sheath 3 or along an inside of the sheath 3. A material 4 separates the core 2 and the sheath 3 and has a negative temperature coefficient.

The sensor C of the illustrated embodiment further comprises a wire 1 and an insulating material 5 that separates the wire 1 from the sheath 3. In one embodiment, the wire 1 is made of a material having a positive temperature coefficient ("PTC"), for example, a Nickel (Ni) wire, and is, for example, wound around the sheath 3. The wire 1, the core 2 and the sheath 3 are connected to the device T via terminals l*a*, 2*a* and 3*a*. The whole assembly is placed in an external sheath 6.

Variations in a resistance $R_{Ni}$ of the wire 1 are directly proportional to variations in the mean temperature of the sensor C. The variation in a resistance $R_{NTC}$ of the material 4 allows local areas of overheating to be detected. For overheating over a given portion of the sensor C, the resistance $R_{NTC}$ of the material 4 varies with temperature, i.e., it decreases exponentially.

The device T performs resistance measurements and determines through these measurements the resistance $R_{Ni}$ of the wire 1 and the resistance $R_{NTC}$ of the material 4. The resistance values obtained are processed to deduce information regarding possible general or local areas of overheating. Further, the device T processes the resistance values to deduce inconsistencies indicative of a malfunction such as short circuits, open circuits, fouling, etc.

For a particular application and under normal operational conditions, the resistance $R_{Ni}$ of the wire 1 normally takes values which, depending on the envisaged application, lie within a given range. This range depends on the parameters of the wire 1, such as length and diameter. For example, for a length of about 1 m, the range extends between a few ohms (e.g., 20 ohms) and a few hundred ohms (e.g., 200 ohms). The device T therefore compares the measured resistance value of the wire 1 with expected maximum and minimum resistance values for that particular application. When the resistance value of the wire 1 lies outside the given range, the device T triggers the transmission of a signal indicative of a malfunction of the sensor C.

Figure 2:
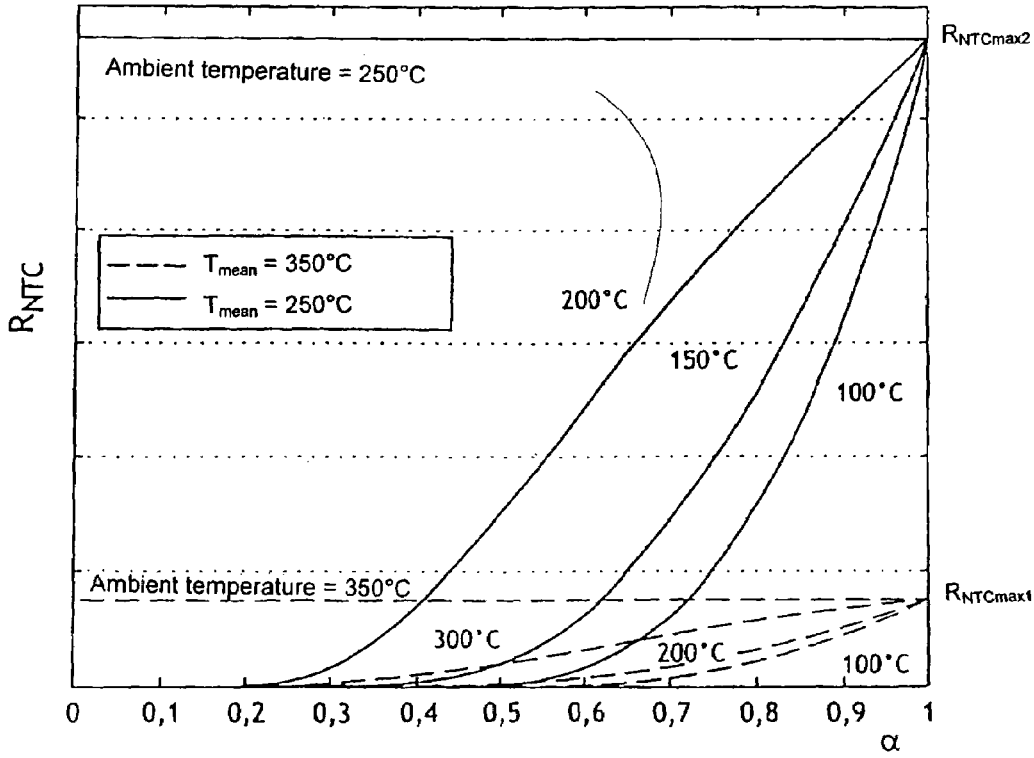
FIG. 2 shows schematic graphs illustrating the resistance of a material with a negative temperature coefficient as a function of temperature and a sensor portion subject to overheating.

FIG. 2 shows several schematic graphs illustrating the resistance $R_{NTC}$ of the material 4 having a negative temperature coefficient as a function of a sensor portion α subject to overheating. If α=1, the entire sensor is subject to overheating, and if α=0.5, half of the sensor length is subject to overheating. The graphs are given for two mean temperatures 250° C. and 350° C. measured on the basis of the resistance variations of the wire 1, and for various ambient temperatures 100°, 150°, 200° and 300° C. As shown in FIG. 2, the graphs representing the resistance $R_{NTC}$ for a given ambient temperature and mean temperature terminate in a maximum limiting value $R_{NTCmax1}$, $R_{NTCmax2}$. It is contemplated that a resistance value above the limiting value $R_{NTcmax1}$, $R_{NTcmax2}$ is indicative of a defect or perturbation of the sensor C.

A measured resistance $R_{Ni}$ of the wire 1 is indicative of a given overall temperature of the sensor C. For that overall temperature a limiting value $R_{NTCmax1}$, $R_{NTCmax2}$ exists at a α=1, i.e., when the entire sensor is subject to overheating. The device T compares the measured resistance $R_{NTC}$ with the limiting value $R_{NTCmax1}$, $R_{NTCmax2}$ for the given overall temperature. When the resistance $R_{NTC}$ is greater than this limiting value $R_{NTCmax1}$, $R_{NTCmax2}$ the device T triggers the transmission of a signal indicative of a malfunction of the sensor C.

Figure 3:
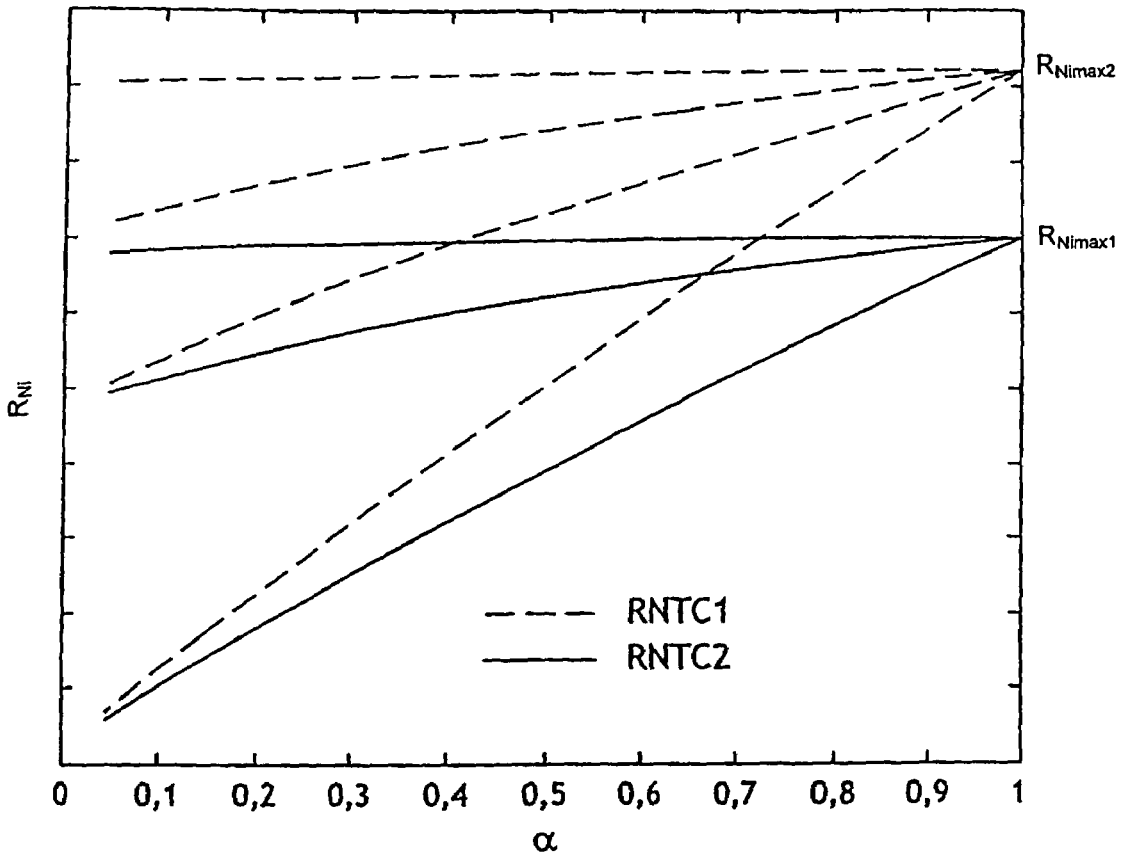
FIG. 3 shows schematic graphs illustrating the resistance of a nickel wire as a function of a sensor portion subject to overheating.

FIG. 3 shows several schematic graphs illustrating the resistance $R_{Ni}$ Of a nickel wire as a function of the sensor portion α subject to overheating for several mean temperatures. Corresponding to each resistance value $R_{NTC\ 1,2}$ of the material 4 is a maximum nickel resistance value $R_{Nimax1}$, $R_{Nimax2}$ at α=1. That is, the resistance $R_{NTC}$ is used to determine a possible value for the resistance $R_{Ni}$, which has to be within a given range for a particular sensor C. For a given value of the resistance $R_{NTC}$ with a negative temperature coefficient, the device T performs a comparative processing operation to check that the mean temperature corresponding to the nickel resistance $R_{Ni}$ is below a given limiting value $R_{Nimax1}$, $R_{Nimax2}$ since the mean temperature cannot be higher than the ambient temperature. When this is not the case, the device T triggers the transmission of a warning signal indicative of a malfunction of the sensor C.

The device T also performs a dynamic processing operation by analysing variations in one or more parameters, for example, to indicate overheating or an inconsistency in the measurements. Thus, to determine local overheating or general overheating, the device T compares certain threshold values not to the resistance $R_{NTC}$ of the material 4 and the resistance $R_{Ni}$ of the wire 1 directly, but to differential values of these resistances.

Figure 4:
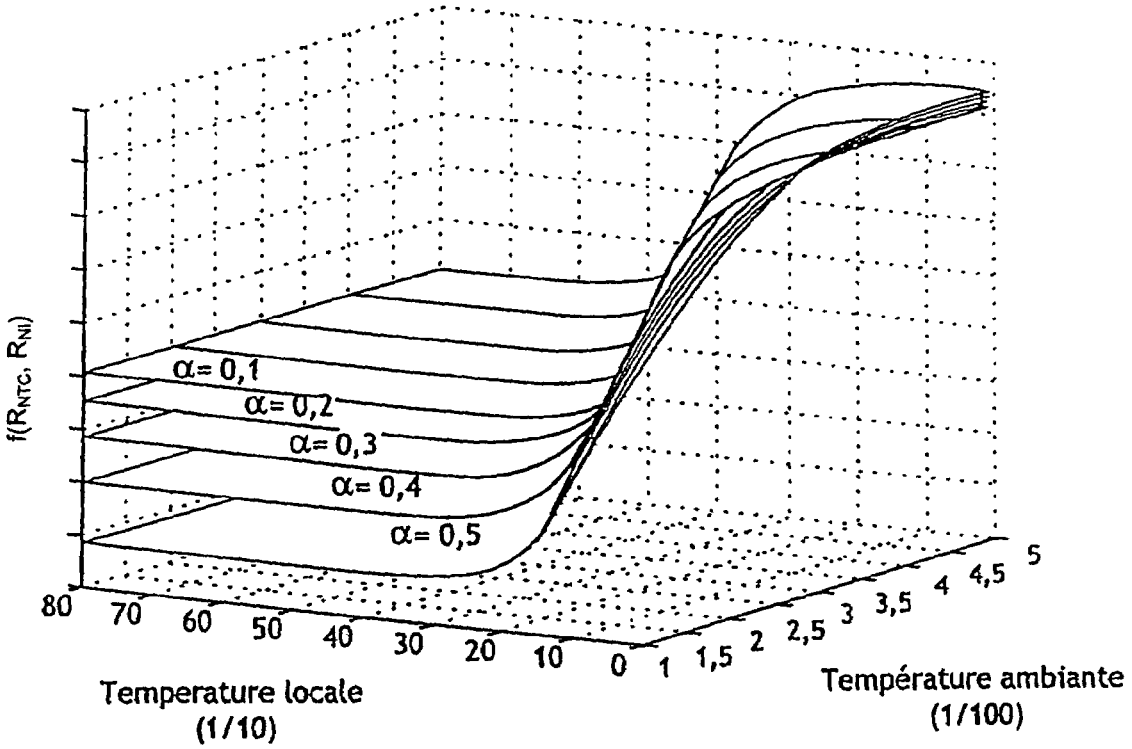
FIG. 4 shows graphs as a function of a sensor portion subject to overheating, local temperature and mean temperature.

The device T advantageously determines the sensor portion α that is subject to overheating and performs a consistency test on the determination thus made. This includes analysing the variations in $\log(R_{NTC})$ (i.e., the difference between $\log(R_{NTC})$ at time T1 and $\log(R_{NTC})$ at time T0) and the variations in the resistance $R_{Ni}$ of the wire 1 (i.e., the difference between $R_{Ni}$ at time T1 and $R_{Ni}$ at time T0). The parameters that constitute $\log(R_{NTC})$ and the resistance $R_{Ni}$ of the wire 1 are in fact parameters which have been shown to vary linearly with temperature (local temperature and ambient temperature, respectively). FIG. 4 illustrates the values of a ratio of the variations of $\log(R_{NTC})$ and $R_{Ni}$ for various values of the sensor portion α subject to overheating. The ratio values are plotted as a function of the measured local temperatures and mean temperatures.

The ratio of the variations in these two parameters varies with the mean temperature and with the local temperature as a function that depends directly on the sensor portion α that is subject to overheating. In particular, when the local temperature is more than 100° C. above the mean temperature of the sensor C the determined curves are asymptotic curves that depend directly on the value of the sensor portion α, but not of the temperature. This allows to conclude what portion of the sensor C is overheated, for example, 50% of the sensor C is overheated.

Figure 5:
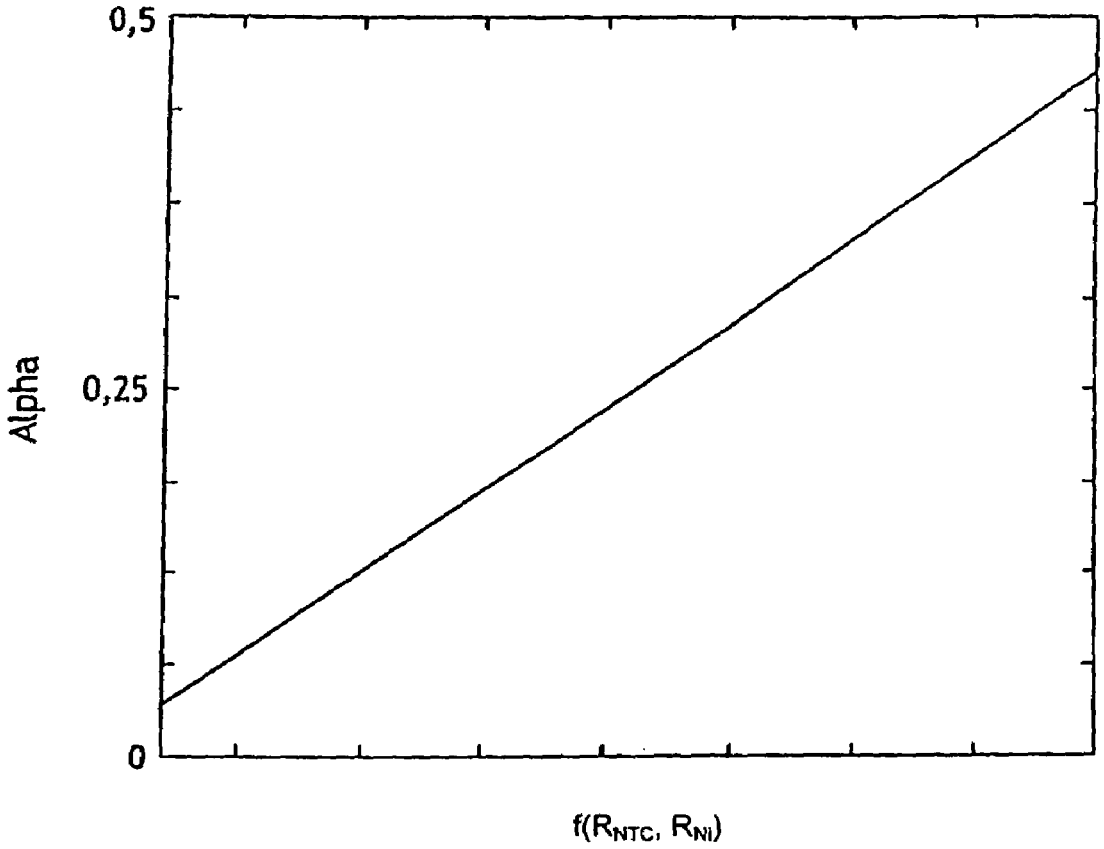
FIG. 5 is a graph illustrating a sensor portion subject to overheating as a function of the graphs shown in FIG. 4.

Similarly, in FIG. 5, the asymptotic value taken by the aforementioned ratio has been plotted for various values of α. Thus, the device T determines the value of α that corresponds to the variations in the values of log ($R_{NTC}$) and $R_{Ni}$ that the device T measures. The device T analyses the consistency of the determined α value and when the α value exceeds the [0,1] range transmits a signal indicative of a failure of the sensor C.

Other ratios of variations could be used. In particular, the ratio of differential values of $\log(R_{NTC})$ and $R_{Ni}$ could be used in the same way, wherein the differential values are calculated on the basis of the values taken by the two parameters $\log(R_{NTC})$ and $R_{Ni}$ at two different measurement times.

Figure 6:
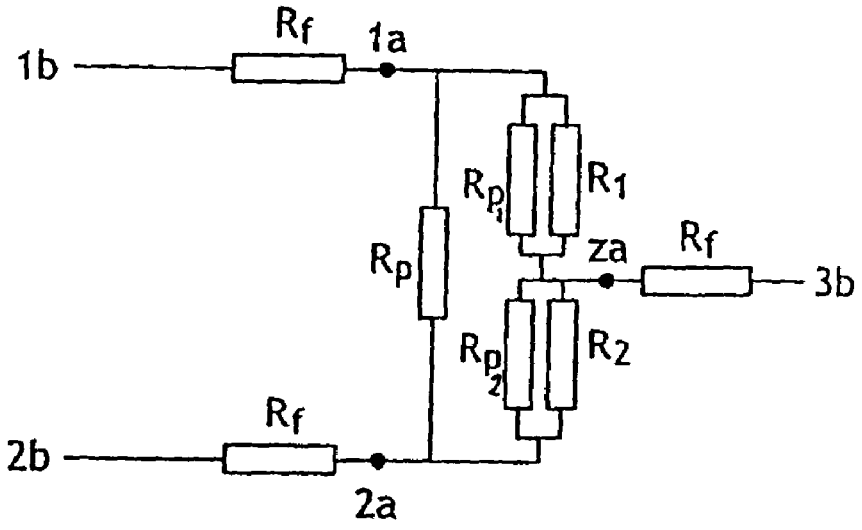
FIG. 6 is a schematic representation of an equivalent circuit diagram of the sensor.

FIG. 6 is a schematic representation of an equivalent circuit diagram of the sensor C including the terminals 1*a*, 2*a* and 3*a* shown in FIG. 1. The circuit diagram includes two resistors $R_1$ and $R_2$ connected via an intermediate terminal ZA. A resistor $R_f$ is connected between the terminal ZA and a terminal 3*b*. The resistor $R_f$ is equal to the resistance $R_f$ of connecting cables that connect the terminals 1*a*, 2*a* of the resistors $R_1$ and $R_2$ to terminals 1*b* and 2*b*, respectively.

A perturbation resistor $R_p$ is also shown connected between the terminals 1*a*, 2*a* of the resistors $R_1$ and $R_2$. The resistor $R_1$ corresponds to the resistance $R_{Ni}$ in parallel with $R_{p1}$, and the resistor $R_2$ corresponds to the resistance $R_{NTC}$ in parallel with $R_{p2}$.

Figure 7:
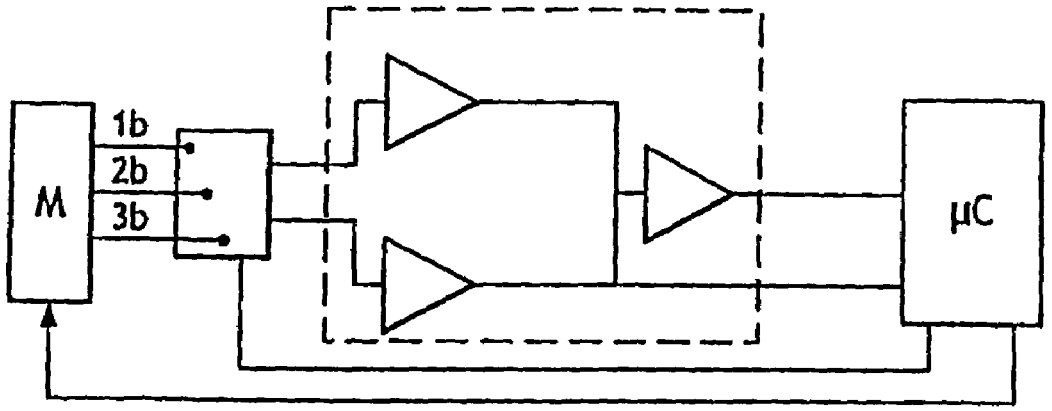
FIG. 7 is a schematic representation of a measuring and processing device connectable to the sensor.

The various resistances between the terminals 1*b* to 3*b* are measured cyclically using a circuit illustrated in FIG. 7. The circuit measures successively the resistance between the terminals 1*b* and 2*b*, the resistance between the terminals 1*b* and 3*b* and the resistance between the terminals 2*b* and 3*b*.

Further, in one embodiment, the circuit determines in succession, the ratio of the voltages $$\frac{U_{1b3b}}{U_{2b3b}},$$

the ratio of the voltages $$\frac{U_{3b2b}}{U_{1b2b}}$$

and the ratio $$\frac{U_{2b1b}}{U_{3b1b}},$$

where $U_{kl}$ denotes the voltage between a terminal k and a terminal l, wherein k and l indicate the terminals 1*b*, 2*b* and 3*b*.

In the illustrated embodiment, the device T of the system comprises a multiplexer M that selects particular terminals of the sensor in order to perform the measurements, and a microprocessor μC that receives outputs from the multiplexer M. In one embodiment, the multiplexer M outputs voltages that may be shaped before input to the microprocessor μC.

The values of the resistances $R_{Ni}$ and $R_{NTC}$ are then determined from the measurements of the resistances between the terminals 1*b* to 3*b*. Thus:

$$R_{Ni} = \frac{R_P \cdot R_1}{R_P - R_1}$$

$$R_{NTC} = \frac{R_P \cdot R_2}{R_P - R_2}$$

$$R_{12} = \frac{(R_1 + R_2) \cdot R_P}{R_1 + R_2 + R_P} + 2R_f$$

$$R_{23} = \frac{(R_P + R_1) \cdot R_2}{R_1 + R_2 + R_P} + 2R_f$$

$$R_{13} = \frac{(R_P + R_2) \cdot R_1}{R_1 + R_2 + R_P} + 2R_f$$

This system of equations can be solved in order to deduce therefrom the values of $R_{Ni}$, $R_{NTC}$ and $R_p$.

The system of equations is generally not invertible in order to obtain $R_f$. The value of $R_f$ can be estimated by assuming that $R_f$ obeys a symmetrical model. In this case, the value of $R_f$, like the value of $R_p$, is compared with maximum values that demonstrate the existence of fouling at the contacts and therefore indicate a state conducive to potential failures. The perturbations in the measurements may also, where appropriate, be corrected accordingly.

In the general case in which $R_p$ and $R_f$ obey an unsymmetrical model, then $R_{Ni}$ and $R_{NTC}$ cannot be calculated directly. However, by considering $R_p$ and $R_f$ as perturbations introduced on the system, it is possible to estimate and put limits on said values of $R_p$ and $R_f$, and consequently to detect an abnormal situation.

The invention claimed is:

1. A system for detecting fire or overheating, comprising:

a sensor comprising at least two materials having different selected temperature coefficients, wherein a resistance of each material is indicative of a temperature; and a device connected to the sensor to perform measurements on the at least two materials, wherein the device is configured to determine at least one parameter from the measurements and to analyze a dynamic behavior of the at least one parameter to deduce status information including overheating and malfunction of the sensor.

2. The system of claim 1, wherein a first material has a first resistance having a negative temperature coefficient, and wherein a second material has a second resistance having a positive temperature coefficient.

3. The system of claim 2, wherein the device is configured to analyze variations in the first resistance to deduce an estimate of a sensor portion subject to overheating.

4. The system of claim 3, wherein the device is configured to compare the estimate of the sensor portion to threshold values and to trigger a signal indicative of a malfunction of the sensor when the estimate exceeds one of the threshold values.

5. The system of claim 4, wherein the device is configured to determine logarithmic variations in one of the first and second resistances.

6. The system of claim 1, wherein the device is configured to compare measured values of at least one resistance with at least one first limiting value and to trigger a signal indicative of a malfunction when the measured values exceed the first limiting value.

7. The system of claim 2, wherein the device is configured to compare the second resistance to a second limiting value that depends on the first resistance, and to trigger a signal indicative of a malfunction of the sensor when the second resistance exceeds the second limiting value.

8. The system of claim 2, wherein the device is configured to compare the first resistance to a third limiting value that depends on the second resistance, and to trigger a signal indicative of a malfunction of the sensor when the first resistance exceeds the third limiting value.

9. The system of claim 1, wherein the sensor comprises a conducting core that extends within a conducting sheath, wherein the first material separates the core and the sheath, wherein the second material is a wire that extends on an outside of the sheath, and wherein an insulating material separates the wire and the sheath, the central core, the sheath and the wire each being connected to a terminal.

10. The system of claim 9, wherein the device is configured to measure according to a predetermined sequence a resistance between a terminal of the central core and a terminal of the sheath, a resistance between a terminal of the central core and a terminal of the wire, and a resistance between a terminal of the sheath and a terminal of the wire, the device further configured to use the resistance measurements to deduce an estimate of the resistance of the first material and an estimate of the resistance of the wire.

11. The system of claim 10, wherein the device is configured to use the resistance measurements to determine at least one estimate of parasitic resistances and to trigger a signal indicative of a malfunction of the sensor when the estimate exceeds a predetermined threshold value for the parasitic resistance.

12. A method of detecting fire or overheating, comprising:

performing measurements on at least two materials having different selected temperature coefficients and comprised in a sensor coupled to a device, wherein a resistance of each material is indicative of a temperature;

determining at least one parameter from the measurements; and analyzing a dynamic behavior of the at least one parameter to deduce status information including overheating and malfunction of the sensor.

13. The method of claim 12, further comprising analyzing variations in a first resistance having a negative temperature coefficient to deduce an estimate of a sensor portion subject to overheating.

14. The method of claim 13, further comprising comparing the estimate of the sensor portion to threshold values and triggering a signal indicative of a malfunction of the sensor when the estimate exceeds a predetermined range.

15. The method of claim 13, further comprising determining logarithmic variations in the first resistance and a second resistance of a second material having a positive temperature coefficient.

16. The method of claim 12, further comprising comparing measured values for at least one resistance with one or more first limiting values and triggering a signal indicative of a malfunction when the measured values exceed one of the first limiting values.

17. The method of claim 15, further comprising comparing the second resistance to a second limiting value that depends on the first resistance, and triggering a signal indicative of a malfunction of the sensor when the second resistance exceeds the second limiting value.

18. The method of claim 16, further comprising comparing the first resistance to a third limiting value that depends on the second resistance, and triggering a signal indicative of a malfunction of the sensor when the first resistance exceeds the third limiting value.

19. The method of claim 15, further comprising measuring according to a predetermined sequence a resistance between a terminal of a central core and a terminal of a sheath, a resistance between a terminal of the central core and a terminal of a wire, and deducing an estimate of the resistance of the first material and an estimate of the resistance of the wire.

* * * * *